US005253909A

United States Patent [19]

Oshita

[11] Patent Number: 5,253,909

[45] Date of Patent: Oct. 19, 1993

[54] COMBINATION OF A CHAIN AND A CHAIN HOOK

[76] Inventor: Harumi Oshita, 5-7-12, Shozoku-Cho, Iwakuni-shi, Japan

[21] Appl. No.: 883,353

[22] Filed: May 15, 1992

[51] Int. Cl.[5] ..... B66C 1/34

[52] U.S. Cl. ..... 294/82.11; 294/82.31

[58] Field of Search ..... 294/82.1, 82.11, 82.13, 294/82.17, 82.24, 82.27, 82.31, 82.33, 82.34, 82.36, 75; 24/68 CT, 69 T, 69 TT, 265 H; 59/85, 93

[56] References Cited

U.S. PATENT DOCUMENTS

| | | | |
|---|---|---|---|
| 466,766 | 1/1892 | Boiteau | 294/82.1 |
| 626,946 | 6/1899 | Vaughn | 294/82.33 |
| 631,697 | 8/1899 | Charest | 294/82.33 |
| 644,063 | 2/1900 | Deyoe | 294/82.34 |
| 958,978 | 5/1910 | Spencer | 294/82.33 |
| 960,522 | 6/1910 | Ebert | 294/82.33 |
| 1,055,281 | 3/1913 | Klefsaas | 294/82.33 |
| 1,370,589 | 3/1921 | Johnson | 294/82.33 |
| 1,477,836 | 12/1923 | McGowan | 294/82.34 |
| 2,395,990 | 3/1946 | Boree | 294/82.33 |

FOREIGN PATENT DOCUMENTS

| | | | |
|---|---|---|---|
| 2743932 | 4/1978 | Fed. Rep. of Germany | 294/82.31 |
| 119218 | 7/1947 | Sweden | 294/82.33 |
| 1146891 | 3/1969 | United Kingdom | 294/82.33 |
| 1284851 | 8/1972 | United Kingdom | 294/82.31 |

*Primary Examiner*—Johnny D. Cherry
*Attorney, Agent, or Firm*—Kanesaka & Takeuchi

[57] ABSTRACT

In a combination of a metal chain and a J-shaped hook, a first ring of the metal chain is connected to a J-shaped hook through a hole provided in a bottom thereof. Therefore, the J-shaped hook can rotate about the first ring at the connection hole and be changed into an approximately inverted J-character shape when hanging from the metal chain in case the chain hook is not used. Moreover, the head portion of the J-shaped hook can be in contact with and held by the first ring so as to keep an approximately J-character shape along the metal chain when the chain hook is used.

4 Claims, 3 Drawing Sheets

COMBINATION OF A CHAIN AND A CHAIN HOOK

BACKGROUND OF THE INVENTION

1. Field of the Invention

The present invention relates to a combination of a chain and a chain hook, particularly to a chain hook which does not work when not used and is excellent in handling.

2. Description of Prior Art

Generally, a plurality of chain hooks for hanging and conveying construction materials or the like are used in a building site or like place, and usually, each of which comprises a chain with a 2 to 3 m length and a hook comprising a hot rolled steel plate with a 3 to 5 mm thickness as shown in FIG. 8. In such a case, these chain hooks are ordinarily piled together when not used, so that each hook is likely to get entangled with a chain or hook of another chain hook. Therefore, much time would be required for taking off such hooking.

In particular, in case of conveying curtain walls, concrete plates, spandrels or materials for scaffolding by a crane in a narrow and high building site, it is very difficult and troublesome for workers to detach one chain hook from such a pile.

SUMMARY OF THE INVENTION

Therefore, I have studied such a construction of the chain hook as to avoid the problem as mentioned above when it contacts with a chain or hook of another chain hook. As a result, the following invention was made.

Namely, it is an object of the present invention to provide a chain hook which can be easily taken off from a pile of a plurality of chain hooks without hooking or getting entangled with others.

One of the features of the present invention is to provide a combination of a metal chain and a J-shaped hook, wherein a first ring of the metal chain is connected to the J-shaped hook through a hole provided in the bottom or hooking portion of the J-shaped hook, and the J-shaped hook takes an approximately inverted J-character shape along a vertical direction of the metal chain when the chain hook is not used, whereas the J-shaped hook takes an approximately J-character shape along the metal chain when the chain hook is used while the head portion of the J-shaped hook is in contact with the first ring.

Another feature of the present invention is to provide a combination of a chain and a chain hook, wherein the first ring is an ellipsoidal ring and has a stud welded near the top portion thereof, and the stud is engaged in a notch provided at the head portion of the J-shaped hook when the chain hook is used, so that the J-shaped hook keeps an approximately J-character shape along the metal chain.

Still another feature of the present invention is to provide a combination of a chain and a chain hook, wherein the weight of the head portion of the J-shaped hook is so large that the J-shaped hook becomes naturally an approximately inverted J-character shape when it is pulled up through the metal chain in the event that the chain hook is not used.

These and other objects, features and advantages of the present invention will be more apparent from the following description of preferred embodiments, taken in conjunction with the accompanying drawings.

DETAILED DESCRIPTION OF PREFERRED EMBODIMENTS

Hereinafter, examples of the present invention will be described in detail.

Figure 1:
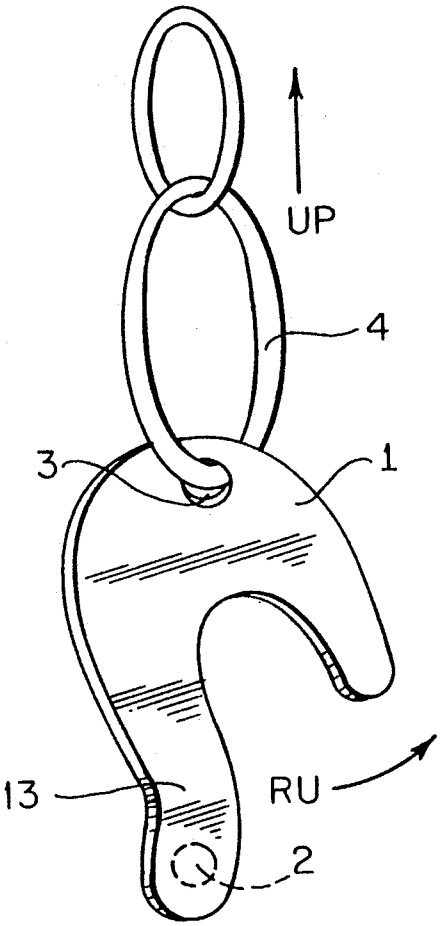
FIGS. 1 and 2 are perspective views for explaining an example of the present invention.
Figure 2:
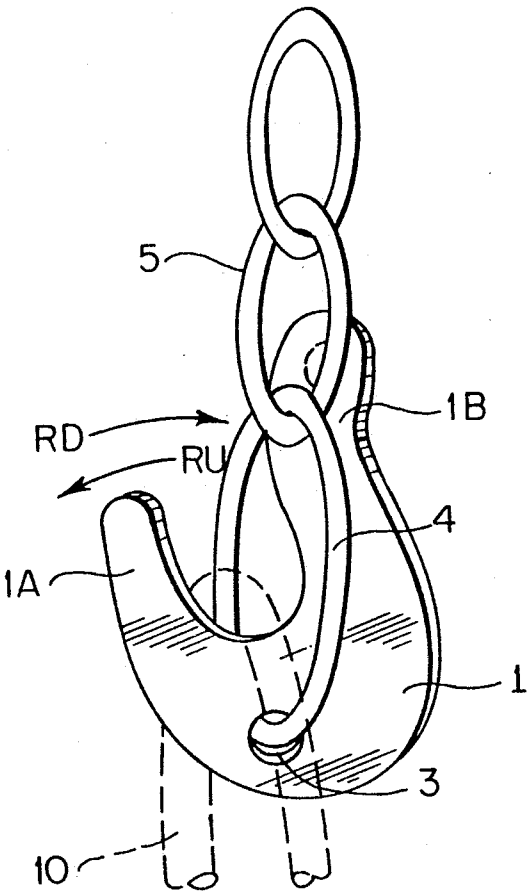

FIGS. 1 and 2 are perspective views showing a typical example embodying the present invention.

FIG. 1 shows a J-shaped hook 1 taking an inverted J shape in accordance with gravitation. Also, the hook 1 becomes a similar inverted J shape, when pulled in the direction designated by an arrow UP in a pile of a plurality of chain hooks, because of frictional resistance caused by other chain hooks around the hook 1. Incidentally, reference numeral 1A denotes a hook tail portion (distal end portion), 1B is a hook head portion, and 2 is a support hole. However, the hole 2 is not required in the present invention. Moreover, reference numeral 3 designates another support hole provided near the bottom portion of the J shape, and 4 shows a first ring of a chain to be connected to the hook 1 through the support hole 3.

The diameter of the support hole 3 is sufficiently larger than the outer diameter of the first ring, so that the first ring can rotate freely about the J-shaped hook 1.

Moreover, the major axis of the first ring is so designed as to be longer than the distance between the center of the support hole 3 and the distal end of the hook tail portion 1A. Therefore, when the J-shaped hook is rotated about the first ring by hand, it is possible to shift a state shown in FIG. 1 to a state in FIG. 2 (or to move the hook in the direction designated by an arrow RU). Accordingly, if a load rope 10, such as wire ropes, hooks or the like, is hooked by the J-shaped hook 1, the hook head portion 1B is rotated in the RU direction about an end portion of the first ring by the rotational moment and then contacts with the other end portion thereof. As a result, the head portion 1B is blocked by the first ring and does not rotate from the contact state. Therefore, the J-shaped hook 1 can work similarly to conventional hooks.

Incidentally, the first ring is followed by a series of rings from second ring 5 to construct a chain.

However, in case of this example in FIGS. 1 and 2, if the load rope 10 is not hooked on the J-shaped hook 1, the head portion 1B is likely to rotate down about the support hole 3 in the direction designated by an arrow RD by vibration or like cause. As a result, the J-shaped hook 1 returns to the state as shown in FIG. 1.

Figure 3:
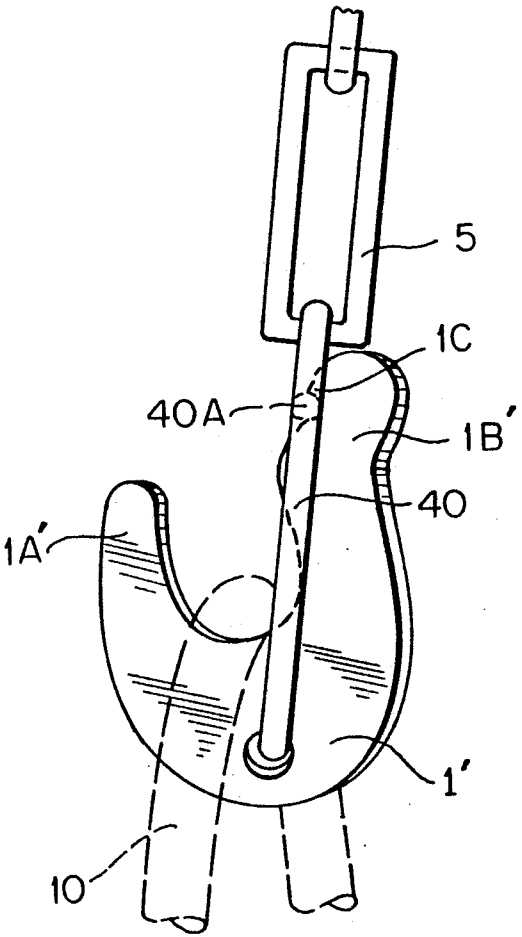
FIG. 3 is a perspective view of another example to improve the first example shown in FIGS. 1 and 2.
Figure 4:
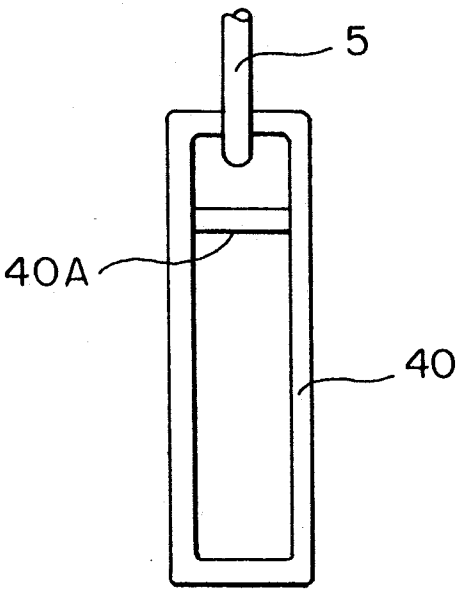
FIG. 4 is a front view of a first ring of the example shown in FIG. 3.

In view of this point, an improvement is made to the first example, in which as shown in FIGS. 3 and 4, a stud 40A is provided in the upper end portion of the first ring by welding to form an improved first ring 40 in a rectangular shape, and a semicircular notch 1C is formed in the head portion 1B' of the J-shaped hook 1', so that the first ring 40 can hold the head portion 1B due to the engagement of the notch 1C with the stud 40A.

In this case, the engagement between the stud 40A and notch 1C is not dissolved naturally or easily detached because the stud 40A is fitted tightly in the notch 1C by effect of the weight of hook 1 by itself. Therefore, the state of the J-shaped hook 1' shown in FIG. 3 would not easily return to that as shown in FIG. 1 if the load rope 10 is not hooked on the hook 1' or removed therefrom.

Figure 6:
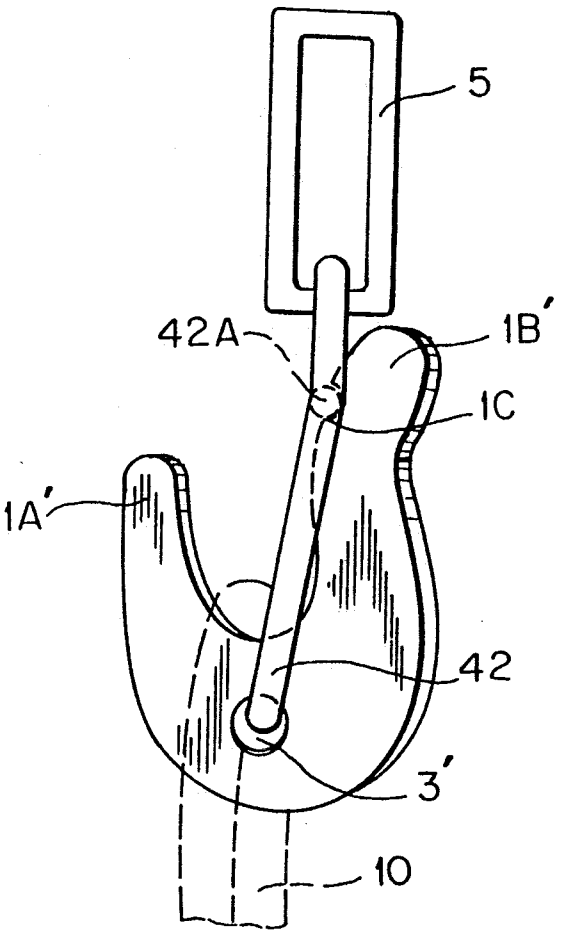
FIGS. 5, 6 and 7 are perspective views of other examples of the present invention.
Figure 5:
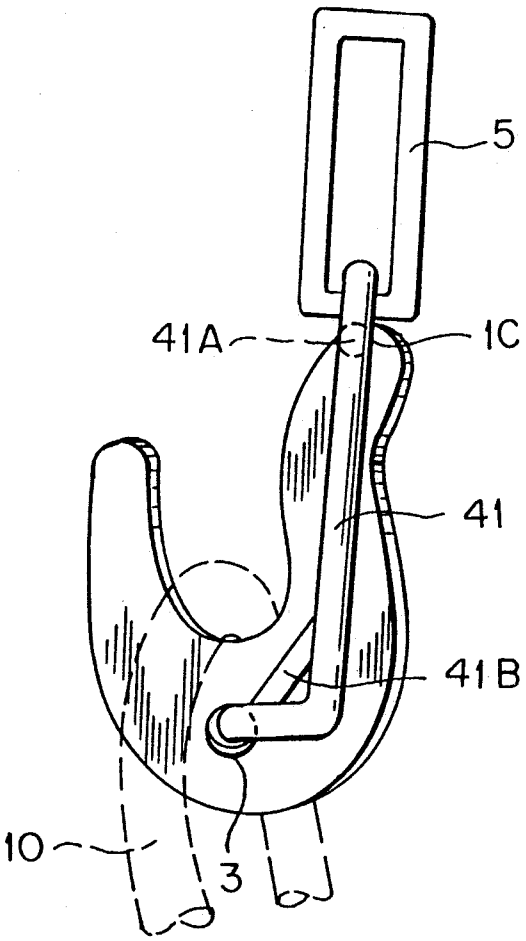
Figure 7:
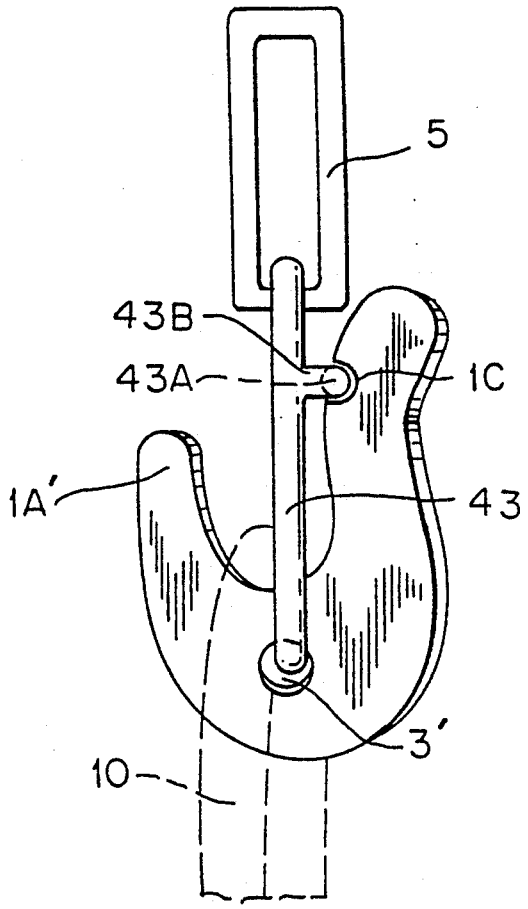
FIG. 7 PRIOR ART
Figure 8:
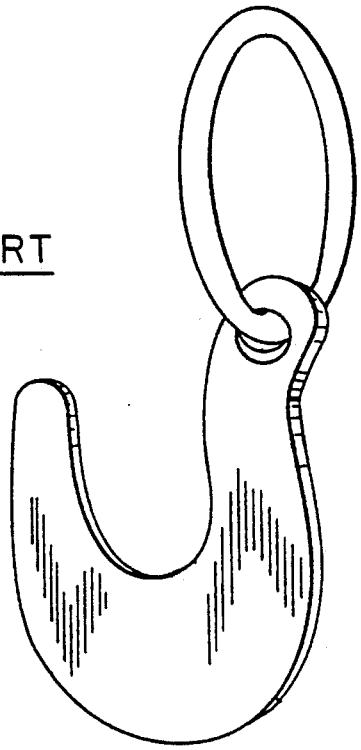
FIG. 8 is a perspective view for explaining a conventional chain hook.

FIGS. 5, 6 and 7 show respectively still other examples of the present invention.

The example shown in FIG. 5 is so constructed that the hooking effect of the J-shaped hook is not affected by the improved first ring 41. Therefore, the ring 41 is bent to form a reversed L-like shape. The ring is reinforced with reinforcements 41B because the bent portions are likely to be distorted by external stress. Also, in case of FIGS. 6 and 7, it is possible to arrange the improved first ring into an L-like shape.

In FIG. 6 showing a further example of the present invention, a first ring 42 is bent slightly at a portion where a stud 42A is provided so that a long slightly inclined portion extends downward therefrom to engage with the support hole 3 and a short straight portion extends upward therefrom to engage with a second chain 5. Therefore, when the chain hook is used, the stud 42A of the first ring engages with a notch 1C provided at a hook head portion 1B of a hook 1' to securely hold the hook 1' in substantially a J-shape.

Further, FIG. 7 shows a still further example of the present invention, in which a first ring 43 of a rectangular shape engages with a second ring 5 at one end thereof and with the support hole 3 at the other end. Arms 43B extend rearwardly from side portions of the ring 43, between which a stud 43A horizontally extends. The stud 43A engages the notch provided at the hook head portion. Therefore, when the chain hook is used, the first ring securely holds the hook in a substantially J-shape.

According to the present invention, it becomes possible to provide a chain hook which can be easily taken off from a pile of a plurality of chain hooks without hooking or getting entangled with others.

Various modifications will become possible for those skilled in the art after receiving teachings of the present disclosure without departing from the scope thereof.

What is claimed is:

1. A combination of a chain and a chain hook for hooking a material, comprising:

a hook having a J-character shape, said hook including a hook head portion at one end, a hook tail portion at the other end, a hook bottom portion located between the hook head portion and the hook tail portion, a support hole provided near the hook bottom portion, a semicircular notch formed at the hook head portion on a side of the hook tail portion, and an inner periphery extending from the hook head portion to the hook tail portion through a portion near the hook bottom portion, a distance between the support hole and the hook head portion being greater than a distance between the support hole and the hook tail portion, and a chain including a first ring directly linked with and passing through the support hole, said first ring including two elongated portions having upper and lower ends, two lateral portions extending laterally from the elongated portions at the lower ends and having distal ends away from the lower ends of the elongated portions, an upper member situated between the upper ends of the elongated portions, a lower member situated between the distal ends of the lateral portions, reinforcing members each situated between the elongated portion and the lateral portion to reinforce the lateral portion, and a stud situated between the elongated portions near the upper ends thereof so that when the hook is not used and hung through the first ring, the J-character hook takes substantially an inverted J-character shape, and when the hook is used by hanging the material at the hook tail portion, the notch at the hook head portion contacts and engages the stud of the first ring to substantially take the J-character along the chain while the elongated portions and the lateral portions are located along-side the hook without crossing the inner periphery of the hook.

2. A combination as claimed in claim 1, wherein the first ring has a longitudinal length longer than a distance between a center of the support hole and a distal end of the hook tail portion of said J-shaped hook so that said hook can rotate about one portion of the longitudinal length to take one of the J-shape and the inverted J-shape.

3. A combination as claimed in claim 2, wherein the first ring has a rectangular shape.

4. A combination as claimed in claim 1, further comprising a second ring connected to the upper member of the first ring above the stud so that the second ring does not affect the hook.

* * * * *